US006340401B1

(12) United States Patent
Wheatley et al.

(10) Patent No.: US 6,340,401 B1
(45) Date of Patent: Jan. 22, 2002

(54) GAS GENERATING COMPOSITION

(75) Inventors: Brian K. Wheatley, Marshall; James D. Martin, Manassas; Robert D. Lynch, Warrenton, all of VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/499,030

(22) Filed: Feb. 7, 2000

Related U.S. Application Data

(62) Division of application No. 09/130,455, filed on Aug. 7, 1998, now Pat. No. 6,136,113.

(51) Int. Cl.[7] ..... D03D 23/00
(52) U.S. Cl. ..... 149/109.6; 149/46; 149/19.91
(58) Field of Search ..... 149/36, 46, 92, 149/19.92, 19.91, 109.6

(56) References Cited

U.S. PATENT DOCUMENTS 4,971,640 A * 11/1990 Chi ..... 149/19.9
5,726,382 A * 3/1998 Scheffee et al. ..... 149/19.91
5,747,730 A * 5/1998 Scheffee et al. ..... 149/47
5,850,053 A * 12/1998 Scheffee et al. ..... 149/19.91
6,017,404 A * 1/2000 Lundstrom et al. ..... 149/36
6,123,790 A * 9/2000 Lundstrom et al. ..... 149/47
6,136,113 A * 10/2000 Wheatley et al. ..... 149/19.91

* cited by examiner

*Primary Examiner*—Michael J. Carone
*Assistant Examiner*—Aileen J. Baker
(74) *Attorney, Agent, or Firm*—Nixon & Vanderhye P.C.

(57) ABSTRACT

An improved thermally stable, storage stable gas generating composition characterized by both an increased burning rate and a decreased pressure exponent for producing a clean, nontoxic, substantially ash- and solids-free gas for inflating inflatable structures such as vehicle airbags is provided. Optimum combustion efficiencies and operating pressures are achieved in the improved gas generating composition by adding an effective amount of a copper or copper compound catalyst to a gas generating composition that is preferably a eutectic mixture or solid solution of ammonium nitrate, at least one highly oxygenated fuel, potassium or cesium perchlorate or nitrate and an optional binder.

15 Claims, 2 Drawing Sheets

COPPER PHTHALOCYANINE EFFECTS IN AA102B

AA102B:
Coefficients:

| | |
|---|---|
| b[0] | -8.4011466218 |
| b[1] | 3.983713357 |
| b[2] | -0.4678116277 |
| $r^2$ | 0.999 |

linear slope (1-8 ksi) = 0.74
(1-4 ksi) = 0.87

2% Copper Phthalocyanine
Coefficients:

| | |
|---|---|
| b[0] | -0.4202164034 |
| b[1] | 0.6562534836 |
| b[2] | 0.3926081046 |
| $r^2$ | 1.000 |

linear slope (1-4 ksi) = 0.67

GAS GENERATING COMPOSITION

This application is a divisional of application Ser. No. 09/130,455, filed Aug. 7, 1998, now U.S. Pat. No. 6,136,113, the entire content of which is hereby incorporated by reference in this application.

TECHNICAL FIELD

The present invention relates generally to gas generating compositions and specifically to a gas generating composition with improved ballistic properties suitable for use in automatically inflating inflatable structures such as vehicle airbags and aircraft escape chutes.

BACKGROUND OF THE INVENTION

Gas generating compositions have long been used for a multitude of purposes. The requirement for vehicular, especially automotive, airbags in passive restraint systems designed to protect drivers and passengers in the event of a collision has produced a substantial amount of research for the ideal gas generating composition for this purpose. The ideal gas generating composition should be a thermally stable, cool burning, noncorrosive composition that generates a large volume of substantially ash or solids-free clean, nontoxic gas. The ideal gas generating composition should also be storage stable so that it ignites effectively and burns efficiently when needed. While the prior art has proposed gas generating compositions that approach this ideal, it has not yet been achieved for automatically inflated structures such as vehicle airbags.

The current state of the art gas generating compositions, referred to in the gas generator technology as "propellants", typically include an ammonium nitrate oxidizer, either combined with a rubbery binder or in a pressed charge to form a pellet, which is stored until ignited to inflate the airbag or other structure. Various chemical additives, for example highly oxygenated fuels such as guanidine nitrate, aminoguanidine nitrate and oxamide are combined with the ammonium nitrate to aid ignition, modify burning rates, promote smooth burning and produce acceptably low flame temperatures. Combustion catalysts may be included in the composition to increase burning rate, promote ignition and low pressure combustion. However, the metallic additives often used in combustion catalysts produce solids in the effluent gas that may interfere with the gas toxicity, exhaust particulates, or inflation of the airbag or other inflatable structure.

Ammonium nitrate is the most commonly used oxidizer in these types of gas generator compositions. It is readily available, safe to handle, and inexpensive. Moreover, ammonium nitrate burns at low flame temperatures and burning rates to produce a nontoxic, noncorrosive exhaust. Primary disadvantages of using ammonium nitrate as the oxidizer in a gas generator composition are inherently low burning rates, higher pressure exponents, poor combustion at low pressures, and its tendency to undergo phase changes during temperature variations, which causes cracks and voids in the pellet. Cracked pellets are not likely to yield a reliable gas generator when needed. Crack formation can be minimized by employing a binder that is sufficiently strong and flexible to hold the composition together. Pellets formed without a binder additive will crack unless phase change additives are used and/or specific additional components or processing steps are employed.

U.S. Pat. No. 5,545,272 to Poole et al. is illustrative of an ammonium nitrate based gas generating composition for an automobile airbag. The mechanical mixture of ammonium nitrate, nitroguanidine, and a potassium salt described by Poole et al. suffers from some of the drawbacks discussed above, however. This type of composition is subject to the aforementioned ammonium nitrate phase changes due to temperature cycling. Since the composition does not include a binder or phase change modifying component and is not produced to modulate ammonium nitrate phase changes, cracks and voids in the gas generating pellet are a likely result.

U.S. Pat. No. 5,551,725 to Ludwig discloses an inflator composition for a vehicle airbag that includes an oxidizer, such as ammonium nitrate, and a fuel, which may be a nitro-organic, such as guanidine nitrate. The Ludwig composition, like the Poole et al. composition, would not avoid potentially detrimental ammonium nitrate phase changes.

In the foregoing gas generating compositions, as well as in other available gas generators, the burning rates tend to be low and the pressure exponent values tend to be high so that they are not as efficient as desired. These ballistic properties pose challenges in the design of a vehicle airbag unit. Low burning rates lead to high operating pressures and/or thin web designs. High exponents at low pressures lead to poor and variable combustion and unburned residues. Moreover, under these conditions, the thin web designs typically used for the gas generator charges weaken and become friable and are susceptible to vibrational damage so that the storage stability of the gas generator is compromised.

A need exists, therefore, for a thermally stable, storage stable gas generating composition characterized by both an increased burning rate and a lower pressure exponent than heretofore achieved that produces a clean, nontoxic, substantially ash- and solids-free gas at optimum combustion efficiency and operating pressure.

SUMMARY OF THE INVENTION

It is a primary object of the invention therefore, to provide a thermally stable, storage stable gas generating composition characterized by both an increased burning rate and a lower pressure exponent than heretofore achieved that avoids the disadvantages of the prior art and produces a clean, nontoxic, substantially ash- and solids-free gas at optimum combustion efficiency and operating pressure.

It is another object of the present invention to provide a gas generating composition with improved ballistic properties that is ideally suited for effectively and efficiently inflating a vehicle airbag.

It is a further object of the present invention to provide a gas generating composition characterized by an optimum burning rate and an optimum pressure exponent value for automatically inflating inflatable structures such as vehicle airbags, aircraft escape chutes and the like.

It is yet another object of the present invention to provide a gas generating composition that exhibits desirable thermal aging, thermal cycling and pellet strength characteristics.

It is yet a further object of the present invention to provide a catalyst for a gas generating composition with improved ballistic properties that includes a solid solution or eutectic mixture of ammonium nitrate, at least one highly oxygenated fuel, preferably guanidine nitrate (GN) and/or aminoguanidine nitrate (AGN), and an optional phase stabilizer.

It is still another object of the present invention to provide a method for simultaneously increasing the burning rate and lowering the pressure exponent of gas generating compositions containing a eutectic mixture or solid solution of ammonium nitrate, GN and/or AGN, a binder and an optional phase stabilizer without adversely affecting other properties by adding a selected catalyst to the gas generating composition.

The foregoing objects are achieved by providing a gas generating composition with improved ballistic properties comprising a solid solution or eutectic mixture of ammonium nitrate, GN and/or AGN, a phase stabilizer, a binder, and an effective amount of a catalyst selected from copper or copper compounds. A first preferred improved gas generating composition in accordance with the present invention comprises a solid solution or eutectic mixture of ammonium nitrate, guanidine nitrate and/or aminoguanidine nitrate, potassium or cesium nitrate, polyvinyl alcohol, and copper phthalocyanine. A second preferred improved gas generating compound comprises a eutectic mixture or solid solution of ammonium nitrate, guanidine nitrate and/or aminoguanidine nitrate, potassium perchlorate, polyvinyl alcohol and copper phthalocyanine. The second preferred compound can be obtained by replacing the potassium perchlorate with ammonium perchlorate and potassium nitrate in ratios which provide the same ion concentration of $K^+$, $ClO_4^-$ in the remaining mixture of AN/GN and/or AGN/PVA.

The burning rate of the gas generating composition is increased and the pressure exponent of the gas generating composition is simultaneously lowered without adversely affecting other propellant properties by the addition of an effective amount of copper or a selected copper compound to a solid solution or eutectic mixture of the components of the gas generating composition, which is adjusted to maintain the oxygen to fuel ratio in the desired range of 0.88 to 1.0. This entails an increase in AN and decrease in GN and/or AGN.

Additional objects and advantages of the present invention will be apparent to those skilled in this art from the following description, claims and drawings. The scope of the present invention is capable of other and different embodiments and modifications, and the description and drawings are intended to be illustrative, not restrictive.

DESCRIPTION OF THE INVENTION

Figure 1:
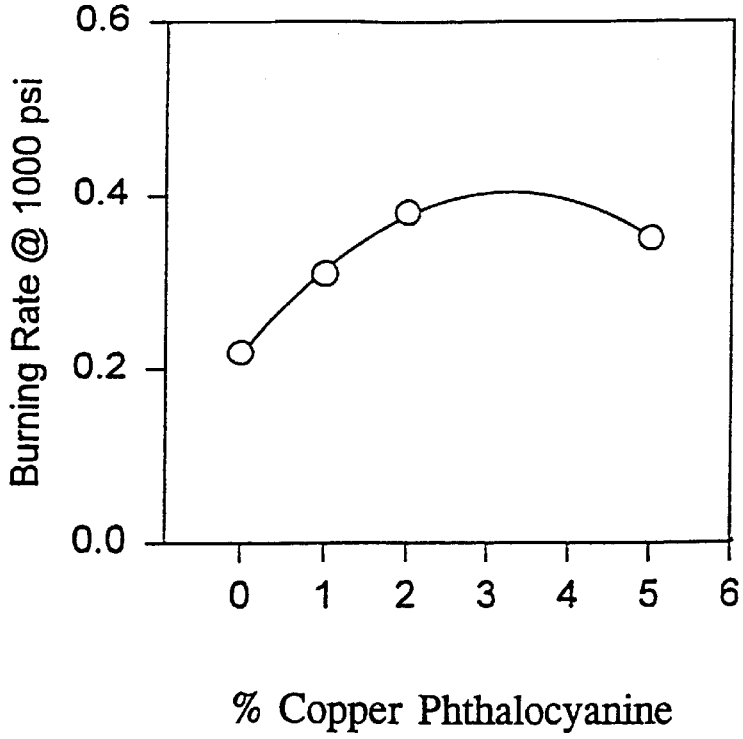
FIG. 1 illustrates in graphic form the burning rate at 1000 psi of a preferred gas generating composition in accordance with the present invention.

State of the art gas generating compositions for vehicle airbags and similar inflatable structures must produce a clean, nontoxic gas effluent with substantially no ash. To date, one of the best approaches to achieving an ash-free effluent has been to use ammonium nitrate in the gas generating composition. The combination of ammonium nitrate and hydrocarbon fuels that contain appreciable levels of oxygen, such as guanidine nitrate and/or aminoguanidine nitrate, produces a clean, substantially ash-free effluent when burned. This type of gas generating composition is formed as a solid solution or a eutectic mixture and generally also contains low levels of a phase stabilizer, particularly potassium nitrate or potassium perchlorate, and a water soluble binder, such as polyvinyl alcohol.

Gas generating compositions comprising solid solutions or eutectic mixtures of ammonium nitrate and guanidine nitrate and/or aminoguanidine nitrate with potassium nitrate or potassium perchlorate do not exhibit the adverse ammonium nitrate phase changes or pellet cracking caused by temperature cycling characteristic of prior art ammonium nitrate gas generating compositions. U.S. Pat. No. 5,726,382, owned by the assignee of the present invention, discloses a gas generation composition that is a eutectic mixture of ammonium nitrate (AN), guanidine nitrate (GN) or aminoguanidine nitrate (AGN), potassium nitrate (KN), and, optionally, a binder. U.S. patent application Ser. No. 08/663,012 filed Jun. 7, 1996, also owned by the assignee of the present invention, discloses a gas generation composition that is a eutectic solution of ammonium nitrate (AN), guanidine nitrate (GN) or aminoguanidine nitrate (AGN), and potassium perchlorate (KP) with a polyvinyl alcohol (PVA) binder. The disclosures of U.S. Pat. No. 5,726,382 and Ser. No. 08/663,012 are hereby incorporated herein by reference. While the gas generating compositions described in these documents have effectively overcome many of the disadvantages, particularly the adverse phase changes associated with ammonium nitrate, characteristic of such compositions, it has been discovered that the ballistics properties of these ammonium nitrate gas generating compositions can be improved greatly, leading to higher combustion efficiency and improved inflator performance.

An effective catalyst that simultaneously increases the burning rates and decreases the pressure exponent value for gas generating compositions comprising solid solutions or eutectic mixtures of ammonium nitrate, highly oxygenated fuels, such as GN and/or AGN, and additives including binders and phase stabilizers has been discovered. The use of copper or copper compounds has been found to be particularly effective in simultaneously raising the burning rate and lowering the pressure exponent value for these gas generating compositions without adversely effecting other desired properties. Copper phthalocyanines are preferred compounds and are currently used as dyes and pigments for plastics, ceramics and other materials, and are known in this art under the family name of Monarch Blue or Pigment Blue. The catalyst activity of copper phthalocyanines in solid solutions or eutectic mixtures of AN and GN, ammonium nitrate or other gas generating compositions was not recognized until the present invention.

The copper phthalocyanine family of compounds suitable for use in accordance with the present invention are referred to herein as Monarch Blue. This term is intended to encompass all chemically and structurally similar copper phthalocyanine compounds with catalytic activity in the kinds of gas generating compositions described herein.

The gas generating compositions of the present invention are typically formed by dissolving all of the compounds in water and mixing them down to dryness, preferably to form a lower melting point eutectic mixture or solid solution. The resulting crumb is then granulated and compacted into pellets, tablets or other convenient forms. Copper or copper compounds are easily dispersed in the aqueous hot melt mixtures used in this method of forming gas generating compositions. At the addition levels employed, the copper or selected copper compound such as Monarch Blue disperses readily with the other composition components in eutectic ammonium nitrate/guanidine nitrate gas generators.

The catalytic efficiency of the addition of copper compounds such as Monarch Blue to specific gas compositions to simultaneously increase the burning rate and lower the pressure exponent has been established by a series of studies. Pellets formed from the gas generating compositions described below were burned to form effluent gases and were also subjected to thermal aging tests, pellet strength tests and hazard tests. Pellet rate burning data showed a substantial increase in burning rate and a decrease in pressure exponent. The thermal aging, pellet strength and hazard test results demonstrated that the presence of copper or a copper compound catalyst does not detract from the nominal properties for the family of gas generators studied.

Gas generation compositions with the formulations set forth below were evaluated. AN represents ammonium nitrate; GN represents guanidine nitrate; KP represents potassium perchlorate; KN represents potassium nitrate; PVA represents polyvinyl alcohol; and MB represents copper phthalocyanines. Copper phthalocyanines were added to both dry and aqueous (aq) gas generator compositions as indicated. The weight percent of each ingredient in the formulation was as indicated. The burning rates and pressure exponent values are compared to Table I, and the pellet strength and durability are compared in Table II.

| COMPOSITION # | FORMULATION | WEIGHT PERCENT |
|---|---|---|
| Baseline AA-102B | GN/AN/KP/PVA | 31/55/9/5 |
| Sample 892 | Baseline/MB (dry) | 98/2 |
| Sample 893 | Baseline/MB (dry) | 95/5 |
| Sample 894 | AN/GN/KP/PVA/MB (aq) | 55/29/9/5/2 |
| Sample 895 | AN/GN/KP/PVA/MB (aq) | 55/26/9/5/5 |
| Sample LS-1 | AN/GN/KP/PVA/MB | 55/30/9/5/1 |
| Sample LS-2 | AN/GN/KP/PVA/MB | 55/29/9/5/2 |
| Sample LS-3 | AN/GN/KP/PVA/MB | 55/26/9/5/5 |
| Sample LS-15[1] | AN/GN/KP/PVA/MB | 60/24/9/5/2 |
| Baseline AA-102A | AN/GN/KN/PVA | 60/30/5/5 |
| Sample LS-4 | AN/GN/KN/PVA/MB | 60/29/5/5/1 |
| Sample LS-5 | AN/GN/KN/PVA/MB | 60/28/5/5/2 |
| Sample LS-20[1] | AN/GN/KN/PVA/MB | 68/20/5/5/2 |

[1]NOTE: Oxygen to fuel ratio adjusted to 0.95.
In Samples 892 and 893 the gas generator formulation was mixed after drying with a dry powder sample of Monarch Blue in the weight percentages indicated. The remaining samples were aqueous blends of the gas generator components.

TABLE I

| | BURNING RATE, ips | | | PRESSURE EXPONENT | | |
|---|---|---|---|---|---|---|
| Sample ID # | 1000 psi | 2000 psi | 4000 psi | 1–2 ksi | 2–4 ksi | 1–4 ksi |
| Baseline AA-102B | 0.23 | 0.44 | 0.77 | 0.94 | 0.81 | 0.87 |
| 892 | 0.27 | 0.48 | 0.86 | 0.83 | 0.84 | 0.84 |
| 893 | 0.27 | 0.52 | 0.99 | 0.95 | 0.93 | 0.94 |
| 894 | 0.38 | 0.65 | 0.96 | 0.77 | 0.56 | 0.67 |
| 895 | 0.35 | 0.61 | 1.04 | 0.80 | 0.77 | 0.79 |
| LS-1 | 0.31 | 0.51 | 0.87 | 0.72 | 0.77 | 0.74 |
| LS-2 | 0.34 | 0.61 | 0.9 | 0.84 | 0.56 | 0.70 |
| LS-3 | 0.33 | 0.62 | 1.16 | 0.91 | 0.90 | 0.91 |
| LS-15 | .35 | .57 | .93 | .75 | .66 | .70 |
| Baseline AA-102A | .18 | .39 | .76 | 1.12 | .96 | 1.04 |
| LS-4 | 0.29 | .53 | .87 | .87 | .72 | .79 |
| LS-5 | 0.3 | 0.5 | 0.86 | 0.74 | 0.78 | 0.76 |
| LS-20 | .29 | .5 | .76 | .79 | .60 | .69 |

TABLE II

| PELLET STRENGTH AND DURABILITY | | | | | | |
|---|---|---|---|---|---|---|
| | Base Properties | | 200 Cycles (−40 to +107° C.) | | 17 Day Aging (+107° C.) | |
| Sample | Crush Strength (psi) | Pellet Diam. (in.) | Crush Strength (psi) | Pellet Dia. (in.) | Crush Strength (psi) | Pellet Dia. (in.) |
| Baseline | 6619 | 0.519 | 6052 | 0.528 | 7626 | 0.521 |
| 892 | 7269 | 0.523 | 6486 | 0.531 | 5831 | 0.530 |
| 893 | 7079 | 0.523 | 6088 | 0.530 | 5543 | 0.530 |
| 894 | 7403 | 0.523 | 5552 | 0.531 | 4847 | 0.536 |
| 895 | 7369 | 0.523 | 5215 | 0.536 | 4684 | 0.536 |

The data in Table II show that the inclusion of 2% to 5% Monarch Blue in the Baseline formulation (GN/AN/KP/PVA) does not have any appreciable impact on pellet strength and durability.

Figure 2:
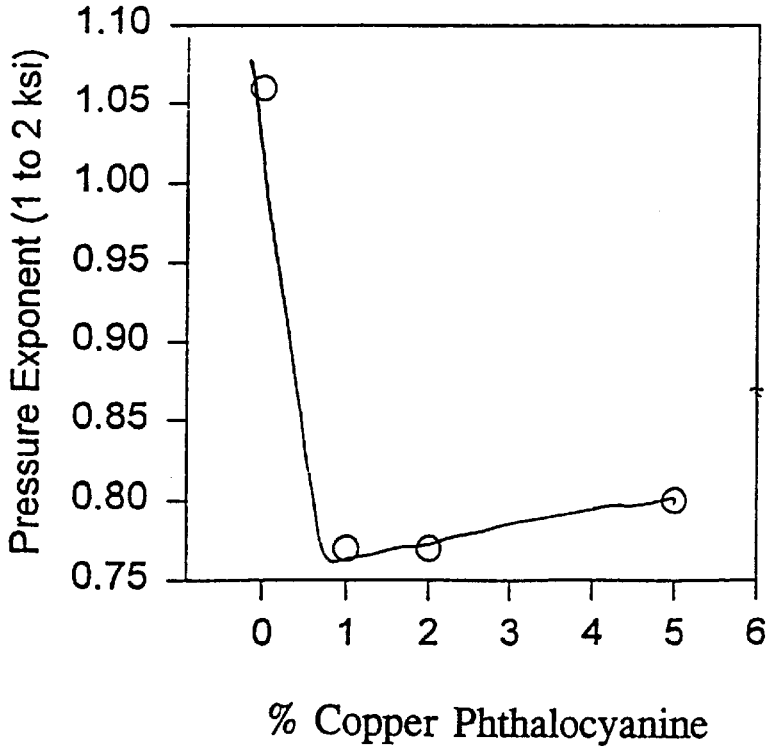
FIG. 2 illustrates in graphic form the pressure exponent at 1–2 ksi of the gas generating composition of FIG. 1.

FIGS. 1 and 2 illustrate, in graphic form, the burning rate and pressure exponent, respectively, of gas generator compositions containing varying percentages of Monarch Blue. The formulations of the gas generator compositions represented in FIGS. 1 and 2 contain ammonium nitrate, guanidine nitrate, potassium perchlorate, polyvinyl alcohol and Monarch Blue (AN/GN/KP/PVA/MB). The burning rate at 1000 psi for amounts of Monarch Blue in this formulation from 0% to 5.0% is shown in FIG. 1. A 2% addition level of Monarch Blue demonstrated the highest burning rate in the study represented by FIG. 1. FIG. 2 shows the effect of Monarch Blue on the pressure exponent at 1 to 2 ksi. The highest pressure exponent was obtained when the gas generator formulation contained no Monarch Blue, while the addition levels of 1% to 5% Monarch Blue to this formulation significantly lowered the pressure exponent. Pellet burning rate data have shown an increase in burning rate of approximately 50%, while the pressure exponent has decreased approximately 20%.

Figure 3:
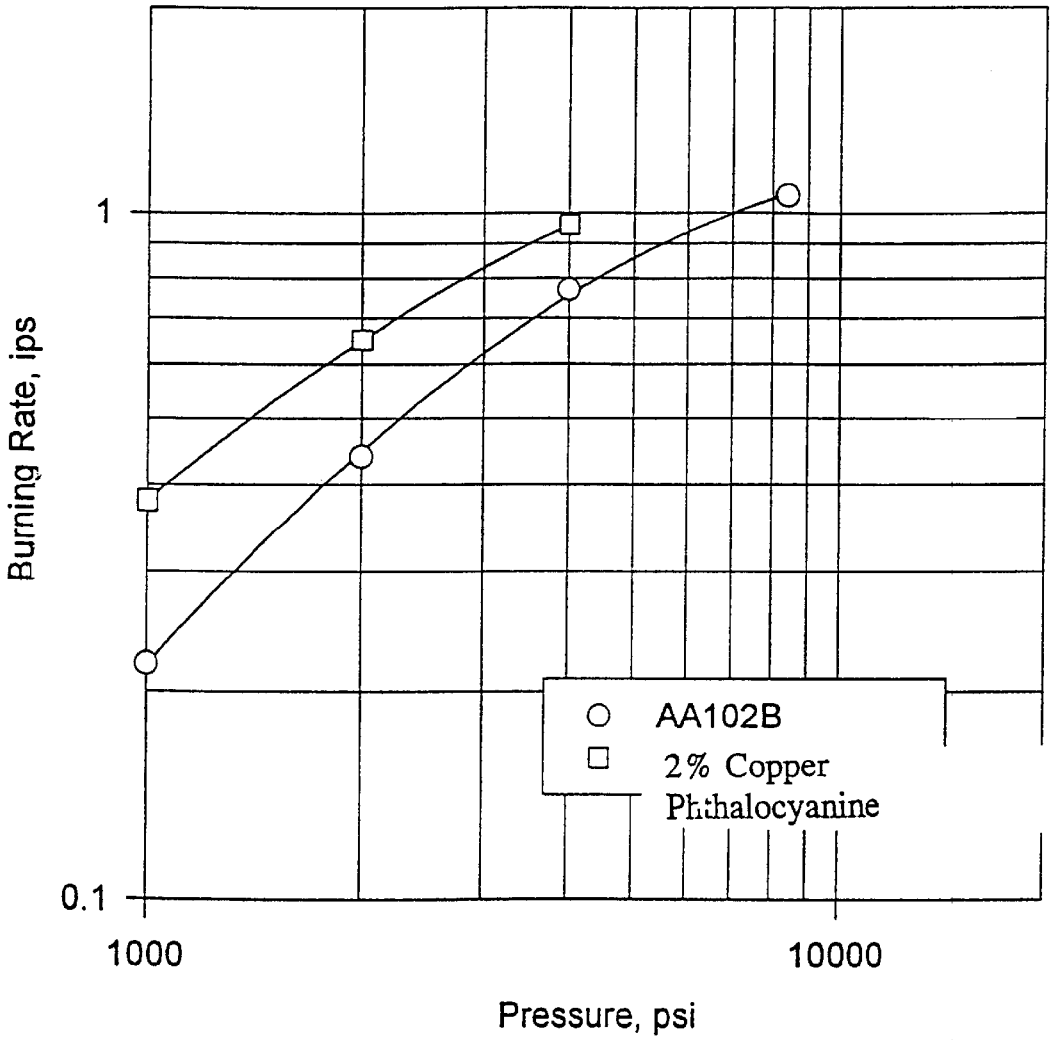
FIG. 3 presents a graphic comparison of burning rate and pressure for a eutectic gas generating composition and for a gas generating composition containing a catalyst in accordance with the present invention.

FIG. 3 compares the effects of 2% Monarch Blue in a gas generator composition having the formulation AN/GN/KP/PVA/MB with a gas generator composition having the formulation AN/GN/KP/PVA.

The foregoing data clearly demonstrates the effectiveness of Monarch Blue in the eutectic mixture or solid solution gas generator compositions tested.

Dispersing the copper phthalocyanine (Monarch Blue) in a hot aqueous melt of the gas generator composition components produced more effective improvements in ballistic properties than blending a dry powder of the Monarch Blue with a powder of the AN/GN/KP/PVA formulation. This is apparent from a comparison of the data in Table 1 for Samples 892 and 893, which were derived from dry blends of powders and Samples 894 and 895, which were derived from hot aqueous melts.

Table III sets forth the burning rate increases in a gas generator composition having the formulation AN/GN/KP/PVA with the addition of other copper compounds as catalysts. The tested formulations were all solid solutions.

TABLE III

| Copper Additive | Wt. % AN/GN/KP/PVA/ADDITIVE | % rate increase[1] |
|---|---|---|
| None | 55/31/9/5/0 | 0 |
| Ammonium tetrachloro cuprate (dihydrate) | 53/31/9/5/2 | +39 |
| Chlorophyllin, (coppered trisodium salt) | 60/24/9/5/2 | +26 |
| Copper (II) acetate | 54/30/9/5/2 | +43 |
| Copper (II) ethylhexanoate | 60/24/9/5/2 | +35 |
| Copper (II) formate | 52/32/9/5/2 | +52 |
| Copper (II) D-gluconate | 55/29/9/5/2 | +48 |
| Copper (II) nitrate (hydrate or non-hydrate) | 50/34/9/5/2 | +22 |
| Copper (II) pyrazine-carboxylate | 56/28/9/5/2 | +39 |
| Copper (II) tungstate | 51/33/9/5/2 | +48 |

[1]burning rate increase @ 1000 psi relative to baseline AA-102B mixture without copper additive

INDUSTRIAL APPLICABILITY

The gas generator formulations of the present invention will find their primary utility in gas generating devices, such as that illustrated in FIG. 6 of U.S. Pat. No. 5,726,382, that are used in connection with vehicle airbags and aircraft escape chutes. However, any application requiring the generation of a clean nontoxic gas will find the improved gas generating composition useful. These could range, for example, from delivering gas to inflatable structures such as life rafts and life vests or jackets to delivering gas to fire suppression apparatus and the like.

What is claimed is:

1. A method of simultaneously increasing the burning rate and decreasing the pressure exponent without adversely affecting other propellant properties in a composition for generating a clean, nontoxic, substantially ash- and solids-free gas to automatically inflate an inflatable structure, comprising forming a eutectic mixture or solid solution of ammonium nitrate, guanidine nitrate and/or aminoguanidine nitrate, potassium or cesium nitrate or perchlorate, a polyvinyl alcohol binder, and adding to said eutectic mixture or solid solution an effective amount of copper or a selected copper compound catalyst.

2. The method of claim 1, wherein the copper compound is a copper phthalocyanine compound.

3. The method of claim 2, wherein 0.1% to 10% by weight of said selected copper phthalocyanine compound is added to said eutectic mixture or solid solution.

4. The method of claim 3, wherein 2% by weight of said selected copper phthalocyanine compound is added to said eutectic mixture or solid solution.

5. The method of claim 3, wherein 5% by weight of said selected copper phthalocyanine compound is added to said eutectic mixture or solid solution.

6. The method of claim 2, wherein the selected copper phthalocyanine compound is added to an aqueous hot melt of said eutectic mixture or solid solution.

7. The method of claim 2, wherein the selected copper phthalocyanine compound is added in the form of a dry powder to a dry powder of said eutectic mixtures.

8. A method of inflating an inflatable structure comprising igniting a gas-generant composition comprised of ammonium nitrate, at least one highly oxygenated fuel, a phase stabilizing composition selected from the group consisting of potassium or cesium nitrate, potassium or cesium perchlorate, an optional binder and a catalyst selected from copper or a copper compound.

9. The method of claim 8, wherein the copper compound is a copper phthalocyanine compound.

10. The method of claim 9, wherein said composition includes up to 6% by weight of said copper phthalocyanine compound.

11. The method of claim 9, wherein the composition has an oxygen to fuel ratio of 0.88 to 1.0.

12. A method of inflating an inflatable structure comprising igniting a gas-generant composition comprised of a eutectic mixture or solid solution-forming mixture of ammonium nitrate, guanidine nitrate and/or aminoguanidine nitrate, potassium or cesium nitrate or perchlorate, a polyvinyl alcohol binder and an effective amount of copper or a copper compound catalyst.

13. The method of claim 12, wherein the copper compound is a copper phthalocyanine compound.

14. The method of claim 13, wherein said composition includes up to 6% by weight of said copper phthalocyanine compound.

15. The method of claim 13, wherein the composition has an oxygen to fuel ratio of 0.88 to 1.0.

* * * * *